United States Patent [19]

McArdle

[11] 4,058,248

[45] Nov. 15, 1977

[54] PRODUCE TRAY

[75] Inventor: James Michael Smith McArdle, Stratford, Canada

[73] Assignee: Domtar Limited, Montreal, Canada

[21] Appl. No.: 701,367

[22] Filed: June 30, 1976

[51] Int. Cl.[2] ..... B65D 5/20

[52] U.S. Cl. ..... 229/30; 229/31 FS

[58] Field of Search ..... 229/30, 34 R, 34 HW, 229/40, 52 A, 28 BC

[56] References Cited

U.S. PATENT DOCUMENTS

| | | | |
|---|---|---|---|
| 1,941,084 | 12/1933 | Gross | 229/34 |
| 2,217,503 | 10/1940 | Bergstein | 229/31 FS X |
| 2,375,631 | 5/1945 | Villard | 229/28 BC X |
| 2,405,310 | 8/1946 | Larkin | 229/52 A |
| 2,591,500 | 4/1952 | Bloomer | 229/31 FS |
| 2,637,482 | 5/1953 | Broderick | 229/30 |
| 3,016,180 | 1/1962 | Struble | 229/30 X |
| 3,291,366 | 12/1966 | Nemoede et al. | 229/30 |
| 3,314,585 | 4/1967 | Forrer | 229/30 X |

FOREIGN PATENT DOCUMENTS

| | | | |
|---|---|---|---|
| 1,368,186 | 6/1963 | France | 229/41 R |
| 1,323,951 | 7/1973 | United Kingdom | 229/41 B |

*Primary Examiner*—Davis T. Moorhead
*Attorney, Agent, or Firm*—C. A. Rowley

[57] ABSTRACT

A blank, or tray, comprising of bottom panel having side walls foldably connected to opposite sides thereof via a pair of substantially parallel side fold lines, end wall forming panels, each of the end wall forming panels being defined in the bottom panel and side walls by a line of weakness extending across said bottom wall and part way into each of said side walls, a first pair of fold line extending one from each end of said line of weakness toward a junction formed with a projection of the adjacent said side fold line and a second pair of fold lines extending one from said line of weakness toward each of said junctions to form in each of said end wall forming panels an end wall and a pair of connecting side walls said first and second pairs of fold lines each being symmetrically positioned on opposite sides of the longitudinal center line of the blank a reinforcing panel connected to each of said side walls one of said reinforcing panels having a flap foldably connected to its free edge and the other of said reinforcing panels having a bottom wall foldably connected to its free edge, the foldable connections between the side walls and said side reinforcing panels and between said one side reinforcing panel and said side flap and said other side reinforcing panel and said bottom wall being substantially parallel to said pair of fold lines connecting said side walls to said bottom panel.

10 Claims, 8 Drawing Figures

PRODUCE TRAY

FIELD OF THE INVENTION

The present invention relates to a tray more specifically the present invention relates to a produce tray or basket.

BACKGROUND OF THE INVENTION

It is common practice to market fresh fruits vegetables and other commodities in open top baskets or trays. A common type of basket is the wood splint basket which is manufactured and remains in an erected position and cannot be stored flat. Another type of basket or tray is formed from fiberboard such as corrugated board and the like, and may be stored in a substantially flat position, and erected immediately prior to use. Examples of such baskets are shown for example Canadian Pat. Nos. 665387 issued June 18th, 1963, to Vesak; 757928 issued May 2nd, 1967, to Vesak; and 770,474 issued Oct. 31st, 1967, to Kotowick. All of the baskets shown in the above patents can be stored in flat position and erected immediately prior to use. However, none provide the simple ease of erection of the present invention, nor do they provide the reinforced bottom as is available from the present invention.

BRIEF DESCRIPTION OF THE INVENTION

Broadly the present invention relates to a blank or tray comprising a bottom panel, side walls foldably connected to opposite sides of said bottom panel via a pair of substantially parallel side fold lines, a pair of end wall forming panels, each of said end wall forming panels being defined in said bottom panel and side walls by a line of weakness extending across said bottom panel and part way into each of said side walls, a first pair of fold lines extending one from each end said line of weakness toward a junction formed with the projection of the adjacent said side fold lines and a second pair of fold lines extending one from said line of weakness toward each of said junctions to form in each said end wall forming panels, an end wall and a pair of connecting side walls said first and second pairs of fold lines being symmetrically arranged on opposite sides of the longitudinal centre of said blank, a side reinforcing panel foldably connected to each of said side walls, one of said side reinforcing panel having a flap foldably connected to its free edge and the other of said reinforcing panels having a bottom wall foldably connected thereto, said foldable connections between said side walls and said side reinforcing panels and between said one side reinforcing panel and said flap and said other side reinforcing panel and said bottom wall being substantially parallel to said pair of fold lines connecting said side walls with said bottom panel.

BRIEF DESCRIPTION OF THE DRAWINGS

Further features objects and advantages will be evident from the following detailed description of the preferred embodiment of the present invention taken in conjunction with the accompanying drawings in which.

Figure 1:
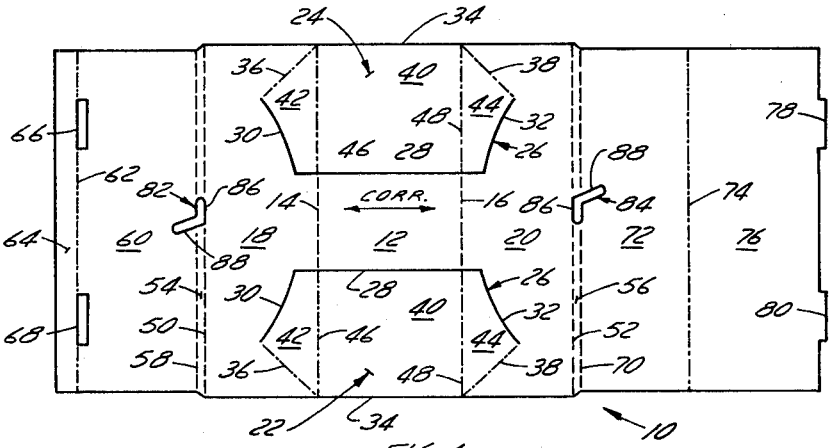
FIG. 1 is a plan view one form of blank incorporating the present invention.
Figure 2:
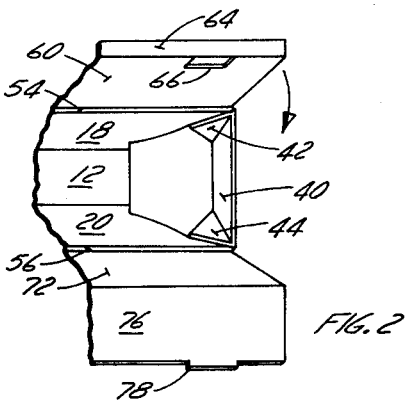
FIG. 2 is an isometric plan view illustrating preliminary steps in setting up a carton from a blank similar to that shown in FIG. 1; but wherein in the erected tray the sidewalls flare outwardly from the bottom wall.
Figure 3:
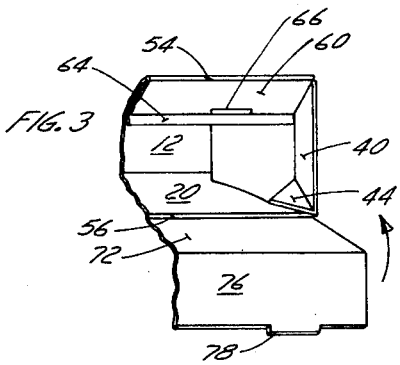
FIG. 3 is a plan view of the tray of FIG. 2 showing further step in erection.
Figure 4:
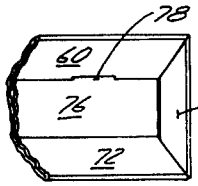
FIG. 4 is a plan view of the erected tray of FIGS. 2 and 3.
Figure 5:
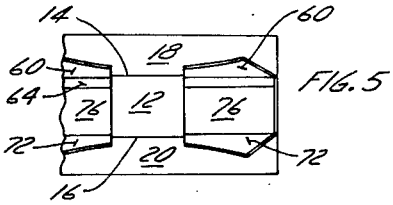
FIG. 5 is a bottom plan view of the tray of FIGS. 2, to 4.
Figure 6:
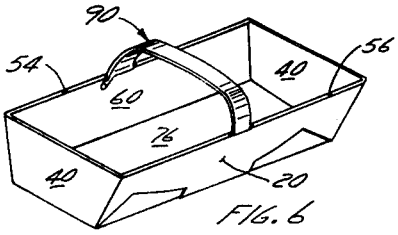
FIG. 6 is an isometric view of a basket formed from the tray in FIGS. 2 to 4.
Figure 7:
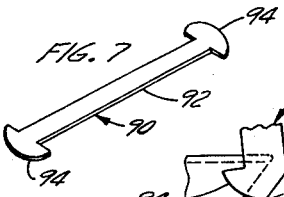
FIG. 7 is an isometric view of one form of handle.

The blank 10 illustrated in FIG. 1 comprises a bottom panel 12 having foldably connected thereto by a pair of substantially parallel fold lines 14 and 16 of pair of side walls 18 and 20. A pair of the end wall forming panels 22 and 24 are formed in said bottom panel 12 and side walls 18 and 20 one adjacent each end of the blank by substantially "U" shaped lines of severance or weakness 26 and fold lines 36 and 38. (The panels 22 and 24 are substantially the same, except mirror images of each other and therefore the same reference numerals have been used to indicate the same parts of the two panels). Each of the lines of severance 26 has a base portion 28 extending across the bottom panel 12 and into the sidewalls 18 and 20 and a pair of arms 30 and 32 extending one from each opposite end of the base section 28 toward an adjacent lateral free edge 34 of the blank. A first pair of fold lines 36 and 38 extend from the ends of the arms 30 and 32 toward a junction where the lines 36 and 38 or projections thereof intersect with the projection of the fold line 14 and 16 respectively. In the illustrated arrangement these fold lines extend to the junctions which coincide with said free edge 34 but this is not essential. Each of the panels 22 and 24 is divided into an end wall 40 and a pair of connecting side walls 42 and 44 via a second pair of fold lines 46 and 48 which extend from said junction point between the fold lines 36 and 38 and said projection of the fold lines 14 and 16 to said line of severance 26, preferably to the base portion 28 of the lines 26.

DESCRIPTION OF THE PREFERRED EMBODIMENT

In the arrangement illustrated in FIG. 1 fold line 46 and 48 are simply projections of the fold lines 14 and 16. However, in the embodiment of FIGS. 2 to 6 inclusive the fold lines 46 and 48 flair away from each other i.e. they extend from the junction point between the projections of lines 14 and 16 and the free edge 34, but their points of juncture with the line 26 are spaced wider than the spacing between the fold lines 14 and 16. These lines 46 and 48 are symmetrical with the longitudinal centre line of the basket, so that both sides of the basket slope upward from the bottom at substantially the same slope.

The pairs of fold lines 36 and 38 and 46 and 48 are symmetrically positioned with respect to the longitudinal centre line of the blank i.e. the lines of each pair are symmetrically arranged one on each side of the longitudinal centre line of the blank.

Foldably connected by a pair of fold lines 50 and 52 to the top edges of the side walls 18 and 20 respectively are top walls 54 and 56.

Connected to the top wall 54 via fold line 58 is a side reinforcing panel 60 which in turn is connected at its opposite side to flap 64 via fold line 62. A pair of apertures 66 and 68 are formed in the reinforcing wall 60 adjacent the fold line 62.

Foldably connected to the top panel 56 via fold line 70 is another side reinforcing panel 72, which has connected to its side remote from the fold line 70 via fold line 74 a bottom wall 76. The bottom wall 76 is provided with a pair of projections 78 and 80 extending from the side thereof remote from its fold line connection 74 and adapted to co-operate with the slots 66 and 68 formed in the reinforcing panel 60 as will be described in more detail herein below.

It will be noted that substantially "L" shaped cut outs 82 and 84 are provided adjacent the centre of the top walls 54 and 56 respectively. One arm 86 of each "L" extends substantially parallel to and along top panel 54 or 56 and the second arm 88 extends at an angle downwardly along the reinforcing panel 60 or 72. These cut outs 82 and 84 are adapted to receive a handle member of the commercial manner, as will be described in more detail herein below.

To erect the tray from the blank of FIG. 1, panels 22 and 24 are lifted from the bottom panel 12 and side walls 18 and 20 and folded along fold lines 36 and 38 into their erected position wherein the walls 40 form the end walls of the tray and the connecting side walls 42 and 44 are in face-to-face relationship with the side walls 18 and 20 respectively. Next the top wall 54 and side reinforcing wall 60 are folded on fold lines 50 and 58 to position the reinforcing wall 60 in overlying relationship with the walls 42 and in substantially face-to-face relationship with the side wall 18 and flap 64 is folded to overlie the bottom panel 12. Thereafter, it is a simple matter to fold the top wall 56, the other reinforcing wall 72 and bottom wall 76 on fold lines 52, 70 and 74 so that the other reinforcing panel 72 overlies the walls 44 and is in substantially face-to-face relationship with the side wall 20, and the bottom wall 76 overlies the bottom wall 12 and the flap 64, while the projection 78 and 80 are received within the slots 66 and 68 respectively to lock the tray in direct position.

Figure 8:
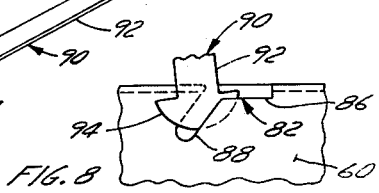
FIG. 8 is a partial view of the inside of the basket illustrating how the handle may be applied.

After the tray has been erected, if desired, a handle 90 formed by a strap 92 having lateral projections 94 at each opposite end thereof may be added by sliding the lateral projections 94 thru the slots 82 as shown in FIG. 8 and then lifting the projections 94 to bear against the top walls 54 and 56 on opposite sides of the basket.

The bottom panel 12 forms a band across the bottom of the tray and forms a sling interconnecting the side walls 18 and 20 whereas the actual supporting bottom wall of the tray is formed in the illustrated arrangement by the bottom wall 76. A double bottom is formed wherein the wall 76 is supported by the bottom panel 12 and by overlaying of the wall 76 with the flap 64 and interconnection of the slots 66 and 68 with the projections 78 and 80. Alternatively the flap 64 may be extended and the wall 76 shortened so they abutt to form the bottom of the tray or other arrangements of the flap 64 and wall 76 may be used to form the bottom of the bag.

If the junction between the lines 36 and 38 with the projection of lines 14 and 16 respectively are not at the free edge 34 of the blank the ends of the lines 36 and 38 will be connected by a slit or line of weakness to permit folding of the panels 22 and 24. Should the lines 36 and 38 extend to the projection of the line 14 and 16 respectively to form junctions spared from the free edge these junctions will be connected by a line of weakness or a fold line to permit movement of the panels 22 and 24 into operative position.

Modifications can be made without departing from the spirit of the invention as defined in the appended claims.

I claim:

1. A tray comprising a bottom panel, side walls foldably connected to opposite sides of said panel via a pair of substantially parallel side fold lines, a pair of end wall forming panels, each of said end wall forming panels being defined in said bottom panel and said side walls by a line of weakness extending across said bottom panel and partway into each of said side walls, and a first pair of fold lines extending one from each end of said line of weakness toward a junction formed with the projection of the adjacent of said side fold lines, a second pair of fold lines extending one from said line of weakness toward each of said junctions to form in each of said end wall forming panels, an end wall and a pair of side connecting walls, said first and second pairs of fold lines being symmetrically arranged with respect to the longitudinal centre line of the tray, each of said side connecting walls being in overlying face-to-face relationship with its adjacent of said side walls, a reinforcing side panel foldably connected to each of said side walls and positioned in face-to-face overlying relationship to the side wall to which it is connected and its adjacent said side connecting wall, end edges at each end of said reinforcing side wall panels, said end edges abutting said end walls thereby to hold said end walls in erected position, one of said reinforcing side wall panels having a flap foldably connected to its free edge and the other of said reinforcing side wall panels having a bottom wall foldably connected to its free end, said foldable connection between said side walls and said reinforcing side wall panels and between said one reinforcing side wall panel and said flap and said other reinforcing side wall panel and said bottom wall being substantially parallel to said pair of fold lines connecting said side walls with said bottom panel, releasable means to lock said bottom wall in face-to-face relationship with said bottom panel and said reinforcing side wall panels in position relative to said side walls, said side connecting walls and said end walls thereby to form the sole means for holding said tray in erected position.

2. A tray as defined in claim 1 wherein said line of weakness is substantially "U" shaped and is composed of a base section extending across said bottom panel and partway into each of said side walls, and a pair or arms extending one from each end of said base portion towards an adjacent free edge of said blank.

3. A tray as defined in claim 1 wherein each said foldable connections between said side reinforcing panels and said side walls includes a pair of fold lines positioned on opposite sides of a top wall.

4. A tray as defined in claim 1 wherein said releasable means comprises aperture means formed in said one reinforcing side wall panel adjacent its fold line connection with said flap and projection means extending from said bottom wall and adapted to cooperate with said aperture means.

5. A tray as defined in claim 1 wherein said junctions are formed at the adjacent free edge of said blank.

6. A tray defined in claim 4 wherein said junctions are formed at the adjacent free edge of said blank.

7. A tray as defined in claim 1 wherein each fold line of said pairs of fold lines extends to one of said junctions.

8. A tray as defined in claim 4 wherein each fold line of said pairs of fold lines extends to one of said junctions.

9. A tray as defined in claim 5 wherein each fold line of said pairs of fold lines extends to one of said junctions.

10. A tray as defined in claim 6 wherein each fold line of said pairs of fold lines extends to one of said junctions.

* * * * *